US006732467B1

(12) United States Patent
Luth

(10) Patent No.: US 6,732,467 B1
(45) Date of Patent: May 11, 2004

(54) FLIP UP GUN SIGHT

(76) Inventor: Randy E. Luth, 10944 147$^{th}$ Ave. SE., Becker, MN (US) 55308

( * ) Notice: Subject to any disclaimer, the term of this patent is extended or adjusted under 35 U.S.C. 154(b) by 0 days.

(21) Appl. No.: 10/602,165

(22) Filed: Jun. 23, 2003

(51) Int. Cl.$^{7}$ ..... F41G 1/00
(52) U.S. Cl. ..... 42/138; 42/148
(58) Field of Search ..... 42/128, 134, 138, 42/140, 148

(56) References Cited

U.S. PATENT DOCUMENTS

| | | | | | |
|---|---|---|---|---|---|
| 190,782 | A | | 5/1877 | Robbins | |
| 358,747 | A | | 3/1887 | Orr et al. | |
| 410,422 | A | * | 9/1889 | Long | 42/138 |
| 426,887 | A | * | 4/1890 | West | 42/140 |
| 462,475 | A | * | 11/1891 | Dobbel | 42/140 |
| 592,740 | A | * | 10/1897 | Kennedy | 42/138 |
| 658,709 | A | | 9/1900 | Fischer | |
| 714,263 | A | | 11/1902 | Trotter | |
| 835,112 | A | | 11/1906 | Pender et al. | |
| 861,652 | A | * | 7/1907 | Hawkins | 42/136 |
| 937,244 | A | * | 10/1909 | Kennedy | 42/138 |
| 1,070,767 | A | | 8/1913 | Brauning | |
| 1,316,391 | A | | 9/1919 | Scarr | |
| 1,491,141 | A | * | 4/1924 | Johnston | 42/136 |
| 2,788,600 | A | * | 4/1957 | Pokorny | 42/138 |
| 2,939,217 | A | | 6/1960 | Hajek | |
| 3,568,324 | A | | 3/1971 | Jorczak | |
| 3,675,534 | A | | 7/1972 | Beretta | |
| 3,969,827 | A | * | 7/1976 | Ellis | 42/136 |
| 4,689,910 | A | | 9/1987 | Choate et al. | |
| 4,977,676 | A | | 12/1990 | Toupin | |
| 5,142,806 | A | | 9/1992 | Swan | |
| 5,533,292 | A | | 7/1996 | Swan | |
| 5,577,326 | A | * | 11/1996 | Montelin | 42/113 |

* cited by examiner

*Primary Examiner*—Michael J. Carone
(74) *Attorney, Agent, or Firm*—McKee, Voorhees & Sease, P.L.C.

(57) ABSTRACT

Rifle front and rear flip up sights include a base member attached to the gun with a sight arm pivotally attached to the base member and being biased pivotally downwardly from one end of the base member while a support member is biased pivotally upwardly from the opposite end with the free ends of each engaging each other in a locked condition when both are in their raised positions. The sight arm allows the support arm to be pivoted downwardly under the sight arm with the downward bias of the sight arm holding the sight assembly in a locked lowered position.

8 Claims, 3 Drawing Sheets

FLIP UP GUN SIGHT

BACKGROUND OF THE INVENTION

Flip up gun sights are currently being used on guns including AR-15 and M-16 rifles, but the sight arm of the sights are subject to being displaced downwardly at inopportune times, examples of which include moving through trees or bushes, climbing through a window, or maneuvering around vehicles. The current flip up rear sight becomes useless if a foreign object pushes up against the aperture.

What is needed is a flip up front or rear sight which is immune to being rendered inoperative by environmental conditions of use.

SUMMARY OF THE INVENTION

The basic concept of the flip up sight of this invention is applicable to both the front and rear sights. In each case a base member is provided which may be attached to the flat top AR upper receiver including the rear most slot for the rear flip up sight. Other optical or night vision devices may be mounted on the same receiver as the flip up rear sight only requires a minimum of space.

A sight arm is pivotally connected to the base member and is spring biased downwardly against a support arm pivotally attached to the opposite end of the base member and which is spring biased upwardly into engagement with the bottom side of the sight arm. Cooperating lock means are provided at the outer end of the sight arm and upper end of the support arm to lock the sight arm in a raised position making it resistant to impact from foreign objects that would otherwise cause it to be displaced from its raised operative position.

When the sight arm is to be lowered it is first raised off of the support arm and the support arm is then pivoted downwardly under the sight arm which is also pivoted downwardly on top of the support arm thereby locking it in a lowered position flush against the upper receiver. When not in use the flip up sight measures only ⅝" tall which means the rear sight will not interfere with the use of popular combat sights such as the AimPoint CompM2, Trijicon ACOG, and EOTECH holographic sight. If the operator experiences a failure with his AimPoint or EOTECH sight, then he can still utilize the flip up rear sight by looking through the useless optical sight.

DETAILED DESCRIPTION OF THE INVENTION

Figure 1A:
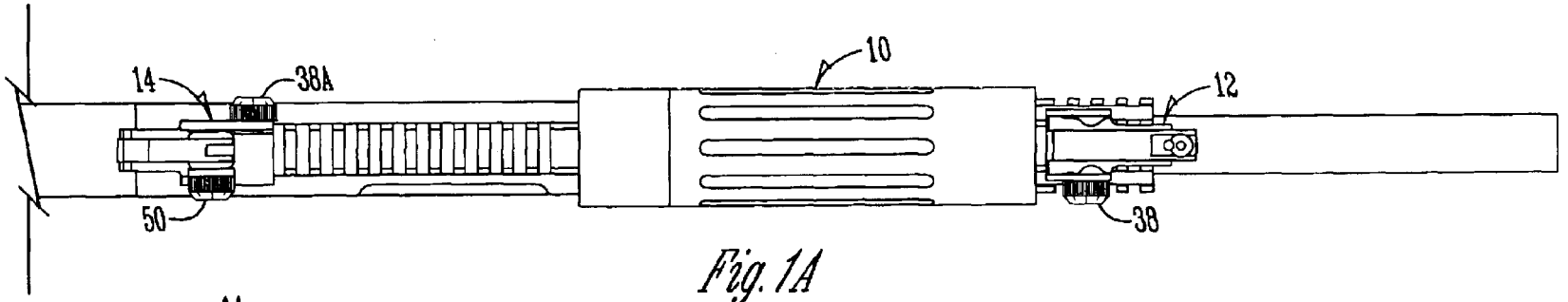
FIG. 1A is a top plan view of a rifle including the front and rear flip up sights of this invention.
Figure 1B:
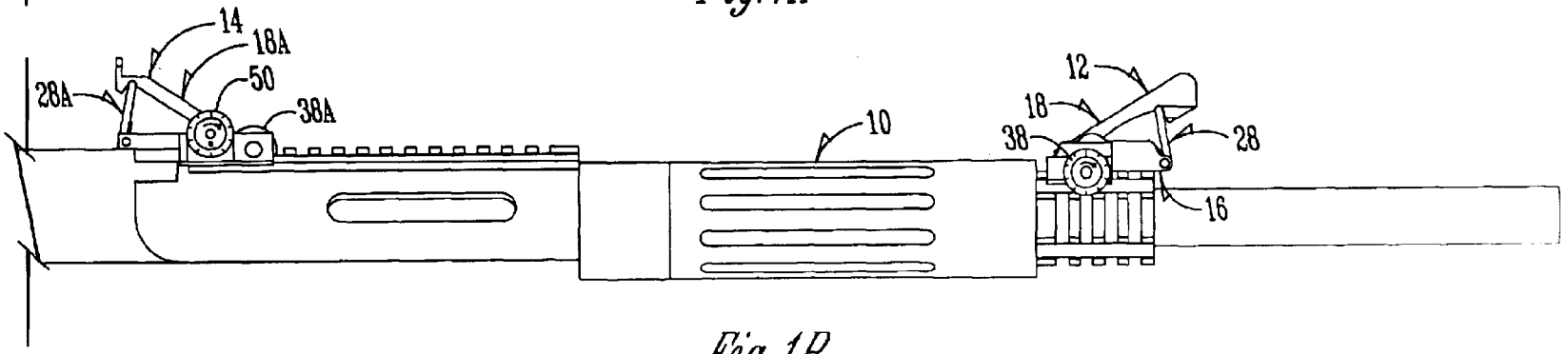
FIG. 1B is a front side elevational view showing both of the front and rear flip up sights in their raised operative positions.
Figure 1C:
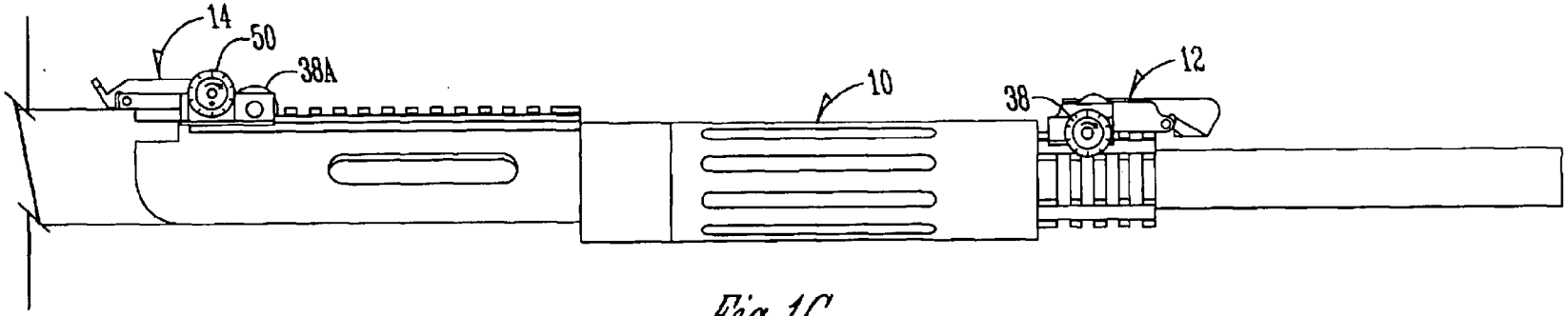
FIG. 1C is a view similar to 1B but showing the front and rear flip up sights in their lowered positions.
Figure 2:
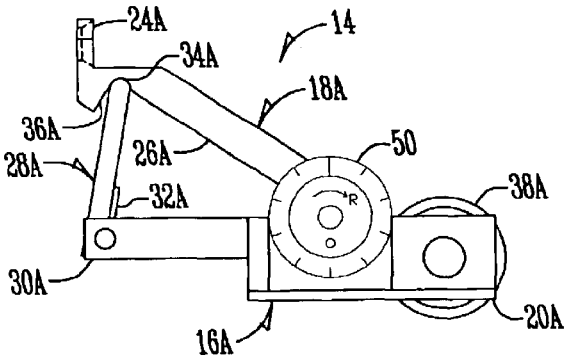
FIG. 2 is a side elevational view of the rear flip up sight shown in 1B in a raised position.
Figure 3:
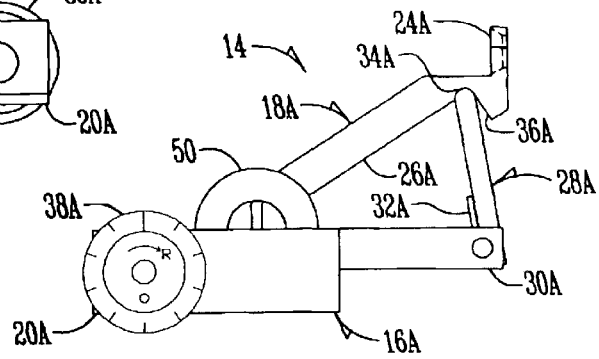
FIG. 3 is a view similar to FIG. 2 but from the opposite side.
Figure 4:
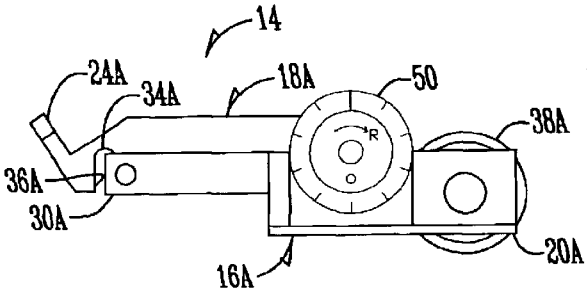
FIG. 4 is a side elevational view of the rear sight of FIG. 1C in a down position.
Figure 5:
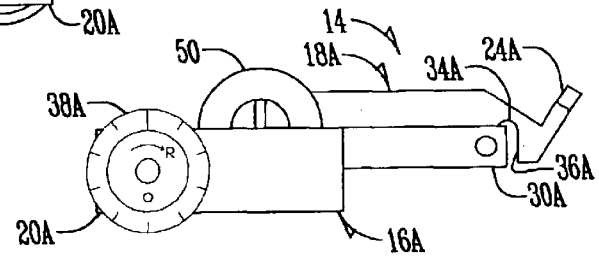
FIG. 5 is a view similar to FIG. 4 but of the opposite side.
Figure 6:
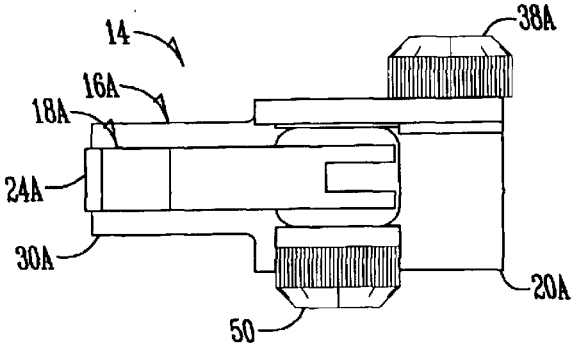
FIG. 6 is a top plan view thereof.
Figure 7:
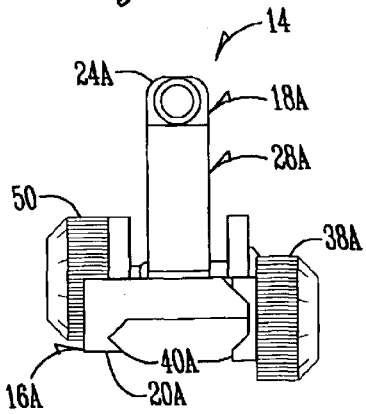
FIG. 7 is an end elevational view from the right hand end of FIG. 6 showing the rear sight in its raised position.
Figure 8:
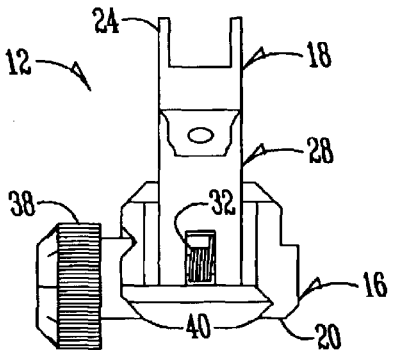
FIG. 8 is an end elevational view of the front flip up sight taken from the right end as viewed in FIG. 1B.
Figure 9:
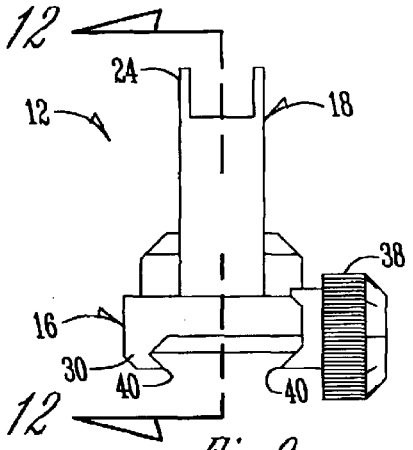
FIG. 9 is a view similar to FIG. 8 but of the opposite end.
Figure 10:
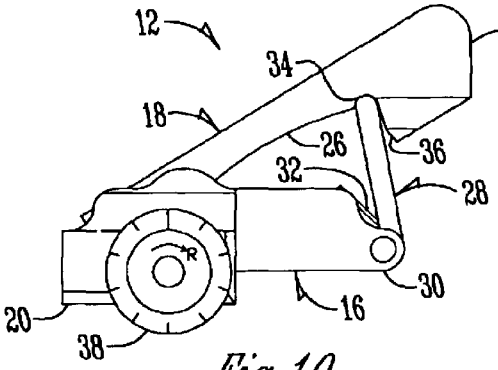
FIG. 10 is a side elevational view from the front side as viewed in FIG. 1B.
Figure 11:
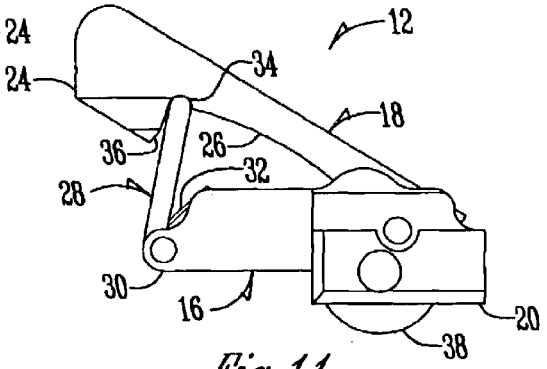
FIG. 11 is a view similar to FIG. 10 but of the opposite side.
Figure 12:
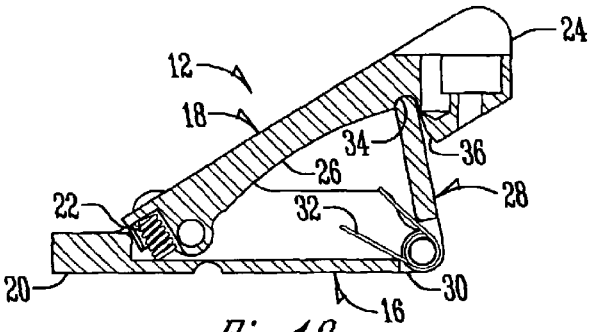
FIG. 12 is a cross sectional view taken along line 12—12 in FIG. 9.
Figure 13:
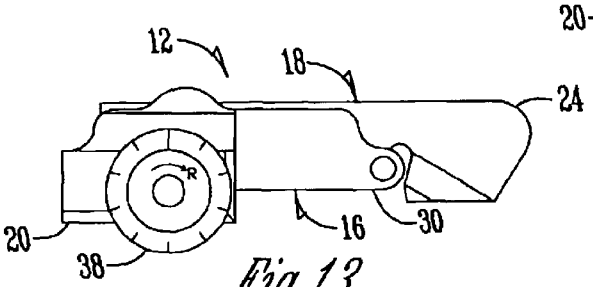
FIG. 13 is a side elevational view of the front flip up sight as seen in FIG. 1C with the sight in a lowered position.
Figure 14:
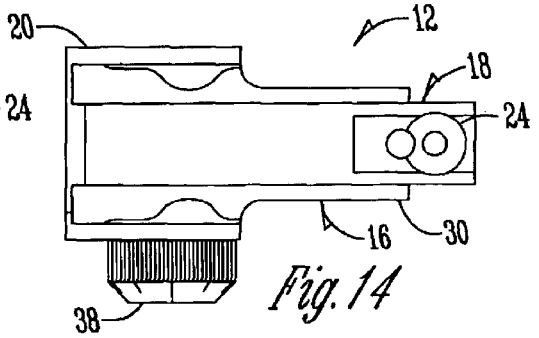
FIG. 14 is a top plan view thereof.

In FIGS. 1A–1C, a rifle 10 includes a front flip up sight 12 and a rear flip up sight 14. These sights are shown in their raised positions in FIG. 1 and in their lowered positions in FIG. 1B and in FIG. 1C.

The basic invention of both the front and rear flip up sights is the same and the sights differ from each other as to the details required for each of the sights.

The front sight 12 includes a base member 16 having a sight arm 18 pivotally connected to a first end 20 of the base member 16 and spring biased downwardly by a compression spring 22. The outer end 24 of the sight arm 18 is engaged on its lower side 26 by a support arm 28 pivotally connected to the second end 30 of the base member 16. A torsion spring 32 biases the support arm 28 upwardly into locking engagement with the upper end 24 of the sight arm 18. A notch 34 is provided in the bottom surface 26 of the sight arm 18 to receive the upper end of the support arm 18. A stop shoulder 36 extends downwardly from the bottom side 26 of the sight arm 18 and limits upward pivotal movement of the support arm 28. The compression spring 22 pressing the sight arm downwardly and the torsion spring 32 pressing the support arm upwardly taken with the cooperating locking surfaces securely locks the sight assembly in a raised operative position.

Conventional elements of the front sight include a clamp knob 38 and clamp jaws 40 for engaging oppositely disposed slots on the front of the rifle.

Functionally similar components of the rear sight 14 are identified by like reference numerals with the added letter "A" such that the basic components are the base member 16A having the sight arm 18A pivoted at one end with the support arm 20A pivoted at the other end 30A.

The rear sight 14 includes a conventional windage knob 50 not used on the front sight 12.

Thus it is seen that the flip up front and rear sights 12 and 14 may be easily attached or removed from a rifle through operation of the clamp knobs 38 and 38A. When the sights are not being used they are compactly lowered flat against the rifle body thus not interfering with the use of conventional optical sights on the rifle. The rifle is also easily stored with the sights in their lowered positions.

When the sights are to be used the sight arms 18 and 18A are raised against the compression springs 22 and 22A while at the same time the support arm 28 and 28A are allowed to pivot upwardly in response to the torsion springs 32 and 32A whereby the upper end of the support arms 28 and 28A are locked in the notches 34 and 34A and against the shoulders 36 and 36A. Foreign objects hitting the sights in the raised position will not alter the sight arms 18 and 18A position thus maintaining reliability of usage for the sights at all times. When the sights are to be taken out of use the sight arms 18 and 18A are raised slightly to allow for disengagement of the support arms 28 and 28A which are now pressed downwardly under the sight arms with the sight arms being allowed to pivot downwardly over the support arms such that the sights are maintained in a locked down position when not being used.

What is claimed is:

1. A flip up gun sight comprising:

a base member having first and second opposite ends;

a sight arm having inner and outer ends pivotally connected at its inner end to said first end of said base member and being pivotal between raised and lowered positions;

spring means for pivotally biasing said sight arm to said lowered position;

a support arm having upper and lower ends with said lower end being pivotally connected to said second end of said base member and being pivotal between raised and lowered positions;

a second spring means pivotally biasing said support arm to said raised position, and said support arm upper end engaging said sight arm outer end when said support arm and sight arm are in their raised positions.

2. The flip up gun sight of claim 1 wherein said sight arm is positioned on and over said support arm in substantially parallel relationship when said sight arm and said support arm are in said lowered positions.

3. The flip up gun sight of claim 1 wherein said outer end of said sight arm and the upper end of said support arm include cooperating lock means for maintaining said sight arm in a raised position.

4. The flip up gun sight of claim 1 wherein said gunsight base member is attached to a gun.

5. The flip up gun sight of claim 4 wherein said gun sight is a rear sight on said gun.

6. The flip up gun sight of claim 4 wherein said gun sight is a front sight on said gun.

7. The flip up gun sight of claim 3 wherein said lock means on said gun sight arm includes a stop limiting said upward pivoting of said support arm when being pivoted to its raised position.

8. The flip up gun sight of claim 7 wherein said sight arm has upper and lower longitudinal surfaces and said upper end of said support arm slidably engages said lower surface of said sight arm when pivoting between said raised and lowered positions.

* * * * *